US005174206A

United States Patent [19]

Molinatto

[11] Patent Number: 5,174,206

[45] Date of Patent: Dec. 29, 1992

[54] PRESSURE CYLINDER FOR A PRINTING MACHINE EQUIPPED WITH AIR-CONDITIONING AND OIL LUBRICATION

[75] Inventor: Bruno Molinatto, Montalto Dora, Italy

[73] Assignee: Componenti Grefici S.r.l., Italy

[21] Appl. No.: 806,046

[22] Filed: Dec. 12, 1991

[30] Foreign Application Priority Data

Dec. 19, 1990 [IT] Italy ..... 22417 A/90

[51] Int. Cl.[5] ..... B41F 3/46; B41F 3/52

[52] U.S. Cl. ..... 101/216; 101/487; 101/424.1; 101/219; 165/89; 100/93 RP

[58] Field of Search ..... 101/216, 487, 488, 424.1, 101/219; 100/93 RP; 165/89

[56] References Cited

U.S. PATENT DOCUMENTS

| | | | |
|---|---|---|---|
| 2,593,595 | 4/1952 | Offen | 101/424.1 |
| 3,282,332 | 11/1966 | Burdick, Jr. | 165/89 |
| 3,308,552 | 3/1967 | Kaufman et al. | 165/89 |
| 3,331,434 | 7/1967 | Lockhart | 100/93 RP |
| 4,176,605 | 12/1979 | Yoshida et al. | 101/451 |
| 4,183,298 | 1/1980 | Cappel et al. | 101/348 |
| 4,188,698 | 2/1980 | Appenzeller | 100/93 RP |
| 4,920,881 | 5/1990 | Tafel | 101/424.1 |
| 5,079,817 | 2/1992 | Anstötz et al. | 165/89 |

*Primary Examiner*—Edgar S. Burr
*Assistant Examiner*—Lynn D. Hendrickson
*Attorney, Agent, or Firm*—Kirschstein, Ottinger, Israel & Schiffmiller

[57] ABSTRACT

Pressure cylinder for a printing machine equipped with air-conditioning and oil lubrication, the receiving shaft of a flexible cylinder casing being made hollow and at its respective ends having an inflow and an outflow for a cooling fluid, the receiving shaft passing furthermore through a chamber which forms an oil reservoir, the reservoir receiving the flexible cylinder casing rotatably, with ball bearings interposed, and this reservoir possessing on its underside orifices for the discharge of the oil and on its topside feed orifices cooperating with plates which extend radially into the immediate vicinity of the inner circumference of the flexible cylinder casing.

6 Claims, 2 Drawing Sheets

PRESSURE CYLINDER FOR A PRINTING MACHINE EQUIPPED WITH AIR-CONDITIONING AND OIL LUBRICATION

BACKGROUND OF THE INVENTION

1. Field of the Invention

The invention relates to a pressure cylinder for a printing machine with air-conditioning and oil lubrication of the cylinder.

2. Description of Related Art

Printing machines employ deformable pressure cylinders, that is to say cylinders with a variable curvature, consisting essentially of a casing which is equipped on its outside with a rubber coating and which is carried by a central supporting shaft, with ball bearings interposed. The supporting shaft is mounted in the side stands of the printing machine.

Pressure cylinders of this type, which are used, for example, for the accurate guidance of the paper web or for pressing the paper web against the compression cylinder, rotate at a considerable speed. For this reason, for the reliable operation of the pressure cylinders it is necessary to provide a perfect lubrication of the ball bearings. It has also proven advantageous if the quantity of heat generated in the pressure cylinders is conveyed continuously away from the cylinder and from the rotating bearings.

In known pressure cylinders, the ball bearings are mostly lubricated by means of a charge of grease, but this lubrication is not without its problems. In the known pressure cylinders, there have hitherto been no means making it possible to air-condition the pressure cylinder in thermal terms, that is to say there have been no known means by which the heat generated could actually be dissipated from the pressure cylinder, especially from the ball bearings of the cylinder, that is to say at points where the cylinder experiences the highest thermal stress. This leads to considerable local heating of the pressure cylinder, especially in the vicinity of the supporting bearings. This accumulation of heat leads, in turn, to a pronounced thermal expansion of the outer cylinder casing, this resulting in an undesirable increase in diameter of the pressure cylinder, particularly in the vicinity of the supporting bearings, thereby entailing dimensional deviations which themselves give rise to printing errors.

SUMMARY OF THE INVENTION

The object of the abovementioned invention is to avoid these disadvantages and to provide simple means by which a reliable, continuous and perfect oil lubrication of the supporting bearings of the pressure cylinder becomes possible, there being the possibility, furthermore, of achieving a continuous and automatic air-conditioning of the pressure cylinder, in order to give the pressure cylinder a uniform temperature over its entire extent.

The object according to the invention is achieved in that the receiving shaft of the flexible cylinder casing is made hollow and at its respective ends has an inflow and an outflow for a coolant, in that the receiving shaft passes through an oil storage chamber, and the oil reservoir receives the elastic casing of the cylinder rotatably via ball bearings, and the reservoir possesses on its underside orifices for the outflow of the oil and on its topside orifices for the feed of the oil, and these feed orifices cooperate with plates which extend radially into the immediate vicinity of the inner circumference of the elastic cylinder casing.

Especially advantageously, at the bottom of the reservoir, in the vicinity of the ball bearings, there are metering tubes, of which in each case one end projects into the oil supply in the reservoir and the other end is directed to the body of the associated ball bearing.

Devices for air-conditioning and oil lubrication which have such features afford the advantage that the oil located in the cylindrical reservoir is constantly in contact with the centrally arranged supporting shaft, with the result that the quantity of oil is cooled continuously; constantly cooled oil is available inside the pressure cylinder.

By the provision of calibrated orifices at the bottom of the oil reservoir, the cooled oil is fed continuously to the inner face of the flexible cylinder casing, and heat is thereby drawn off from this casing continuously by the quantity of oil present.

During the rotational movement of the cylinder casing, as a result of the centrifugal forces occurring the quantity of oil is laid in the manner of a film against the inner face of the cylinder casing. The oil layer is scraped off from the inner cylinder face by the plates which are arranged on the topside of the cylindrical reservoir. Via the bores provided in the vicinity of the blades, the oil is conveyed once again into the interior of the oil reservoir, in order once more to flow via the central cooled shaft.

A constant heat exchange is thus achieved; heat is conveyed away from the inner face of the cylinder casing, and this leads to a uniformity of the temperature on the outer face of the rubber-encased cylinder. Undesirable irregular thermal expansions and dimensional deviations of the outer face of the pressure cylinder are prevented. All the mechanical components of the pressure cylinder are automatically maintained at a constant temperature.

The provision of lubricating tubes ensures a continuous and exactly metered reliable lubrication of each ball bearing. The beak-like lubricating or metering tubes receive oil via an orifice inside the oil reservoir, in order to transfer the oil to the ball bearings in the form of small drops on the opposite side of the tubes.

Especially advantageously, the bores for the outflow of the oil and the bores cooperating with the plates are arranged on a common vertical axis.

Further advantages of the invention can be taken from the following description, drawings and subclaims.

BRIEF DESCRIPTION OF THE DRAWINGS

The subject of the abovementioned invention is now described in more detail by means of an exemplary embodiment and illustrated in the accompanying drawings.

In these.

DETAILED DESCRIPTION OF THE PREFERRED EMBODIMENT

Figure 1:
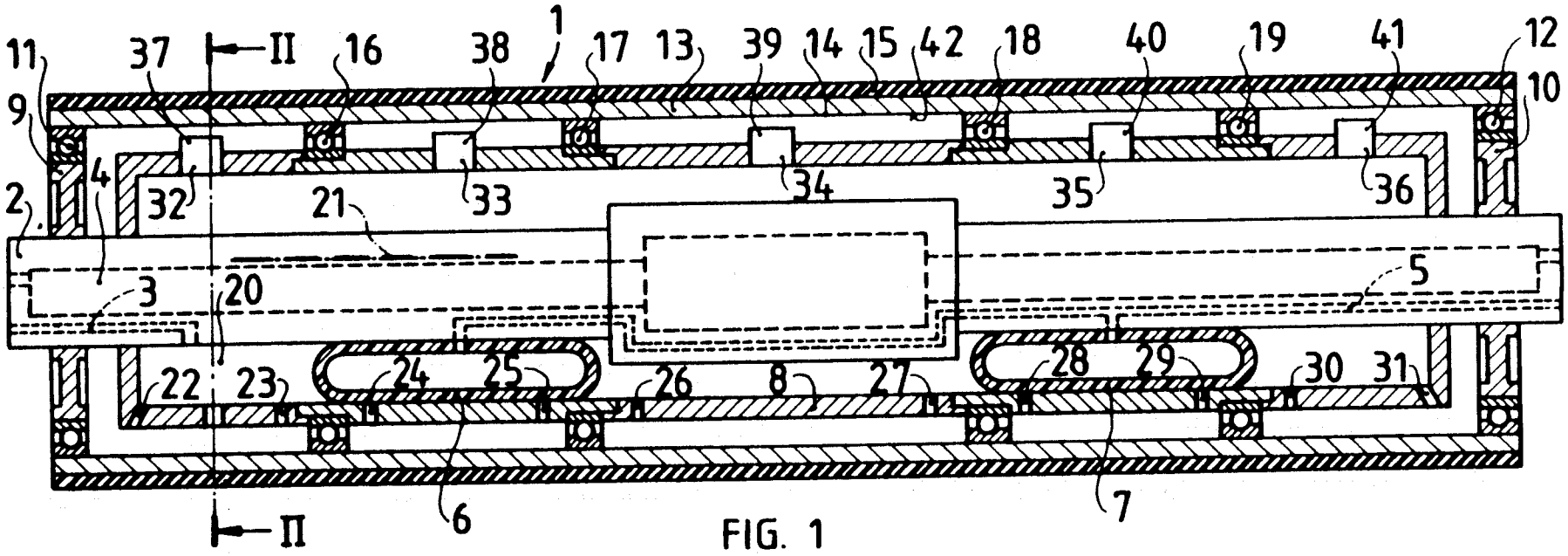
FIG. 1 shows a longitudinal section through the pressure cylinder designed according to the invention.

As can be taken from FIG. 1, the pressure cylinder 1 consists of a centrally arranged receiving shaft 2. This shaft has a line 3 for supply of a specific quantity of oil. Furthermore, the shaft possesses a passage bore 4 which makes it possible to feed from one side of the shaft a coolant which flows to the other side of the shaft. The shaft 2 moreover possesses lines 5 which make it possible to supply compressed air for, two inflatable bellows 6 and 7. The bellows 6 and 7 are provided for the deformation of the pressure cylinder 1. The shaft 2 is surrounded by a cylindrical reservoir 8. Inflatable bellows 6 and 7 are arranged in a known way between the bottom of the reservoir 8 and the supporting shaft 2.

Flanges 9 and 10 are arranged in a known way at the ends of the shaft 2. These flanges support, with ball bearings 11 and 12 interposed, the ends of the elastically deformable cylinder casing 13 which consists of a sleeve 14 made of spring steel or a similar elastic material and which is coated with a coating 15 of soft-elastic material, for example rubber.

In the longitudinal direction of the reservoir 8, the casing 13 rests on further ball bearings 16, 17, 18 and 19. The inner ring of the bearings is received by the cylindrical body of the reservoir 8.

The reservoir 8 is filled with oil 20 via the line 3, so that the reservoir 8 is filled approximately up to the filling level indicated by a dot-and-dash line 21. More than half the circumference of the central shaft 2 is consequently covered by the oil.

Calibrated bores 22, 23, 24, 25, 26, 27, 28, 29, 30 and 31 are arranged on the underside in the wall of the reservoir 8. The number of calibrated bores which is given is not binding and can even be increased, if required.

On the topside, the reservoir wall 8 has orifices 32, 33, 34, 35 and 36. These orifices 32 to 36 are assigned plates 37, 38, 39, 40 and 41 in the manner of a blade. The plates project radially from the cylindrical reservoir 8. The plates project radially outward and reach into the immediate vicinity of the inner wall 42 of the casing 14 which is produced, for example, from spring-steel sheeting. The essential mechanical components which have been described hitherto can also be taken from the drawing according to FIG. 2.

Advantageously, the calibrated bores 22 to 31 and the orifices 32 to 36 are arranged on a common vertical axis.

Figure 3:
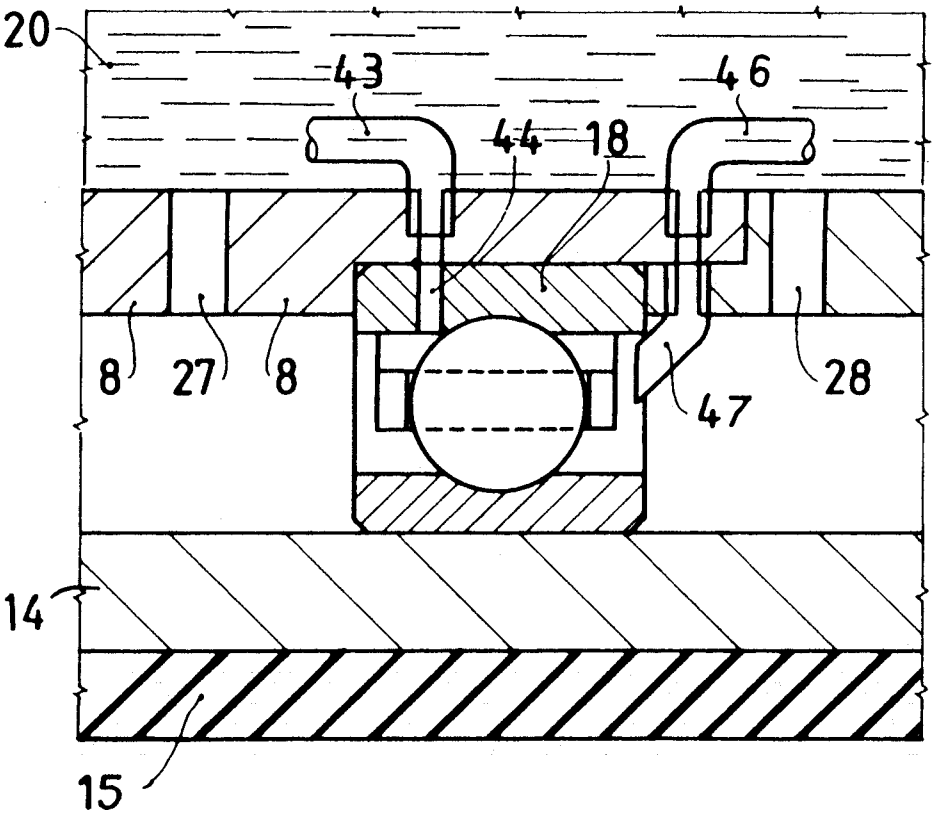
FIG. 3 shows a detail of a ball bearing with the associated lubricating tube on an enlarged scale.

The beak-like lubricating tubes 43 and 46 which are assigned, for example, to a ball bearing 18 and which ensure a constant lubrication of the bearing can be taken in detail from FIG. 3.

The beak-like lubricating tubes can be designed with a different shape and used alternatively, as required.

The lubricating tube 43 consists of an angularly bent tube which at one end extracts oil from the oil supply 20 and via the other end of the tube feeds the extracted quantity of oil in a metered manner to a bore 44 passing through both the bottom of the reservoir 8 and the inner race ring of the ball bearing 18.

In contrast, the beak-like tube 46 has one end projecting into the oil supply 20, and another end 47 is directed to the interspace between the two race rings of the ball bearing 18.

Figure 2:
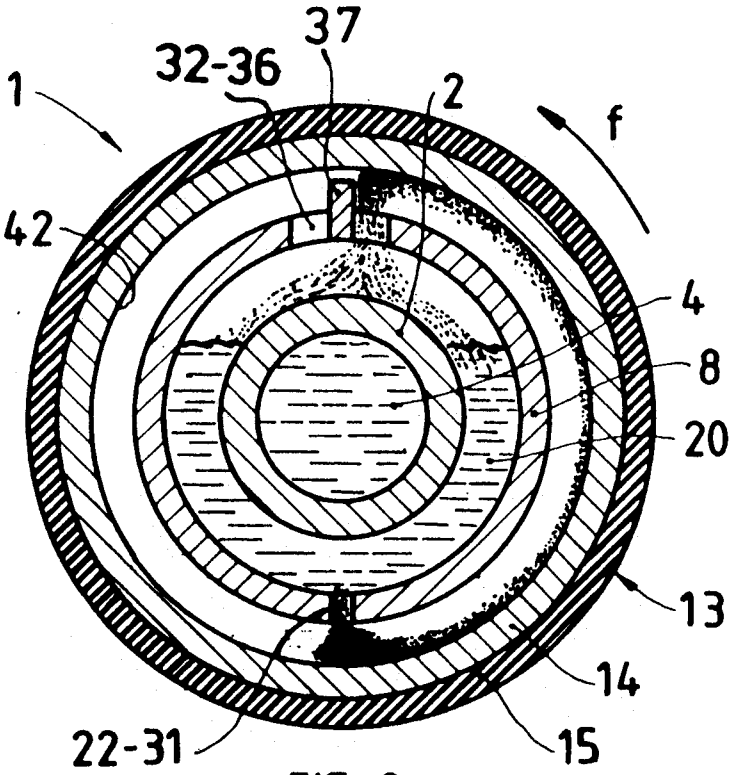
FIG. 2 shows the pressure cylinder in cross-section along the line II—II in FIG. 1.

The operating mode of the air-conditioning and lubricating device is described in more detail by means of FIG. 2.

When the casing 13, 14 and 15 of the pressure cylinder 1 is set in rotational movement according to the arrow (f), the oil which flows via the calibrated bores 22 to 31 onto the inner face 42 of the elastic casing 14 (as a result of centrifugal forces occurring) is applied immediately as a thin film to the wall 42. This film consisting of cooled oil absorbs the heat accumulated in the elastic casing 13 of the pressure cylinder 1. The metal cylinder 14 has an outer jacket 15 made of rubber.

The oil film thus, formed can move unimpeded as far as the blades 37–41. These penetrate into the rotating oil film, constitute an obstacle to this and peel the oil film off from the inner face 42 by means of the scraping effect which occurs. For this, it is not necessary for the blades 37–41 to come into contact with the inner face of the rotating pressure cylinder 1. The heated quantity of oil detached is conveyed into the interior of the cylindrical reservoir 8 once again by the blades 37–41 via the associated bore 32–36.

While the oil detached from the wall 42 of the elastic metal sleeve 14 is trickling down, it flows round the topside of the central cooled shaft 2, so as to be cooled immediately. The heat content extracted from the oil is conveyed away via the cooling fluid which flows through the bore 4 of the shaft.

What is claimed is:

1. A pressure cylinder for a printing machine, comprising: a flexible cylinder casing; a hollow receiving shaft having an inflow and an outflow at its end for coolant; an oil storage chamber with said receiving shaft passing therethrough; and ball bearings interposed between said oil storage chamber and said flexible cylinder casing; said flexible cylinder casing being hollow and rotatably mounted; said oil storage chamber containing oil and having underside orifices for oil outflow and topside orifices for oil inflow; said topside orifices having plates cooperating therewith and extending radially outward to the immediate vicinity of an inner circumference of said flexible cylinder casing.

2. The pressure cylinder according to claim 1, wherein said flexible cylinder casing includes a cylindrical sleeve and an outer elastic coating.

3. The pressure cylinder according to claim 1; and further comprising inflatable bellows interposed between said oil storage chamber and said receiving shaft; and wherein said receiving shaft includes lines for supplying air to the bellows.

4. The pressure cylinder according to claim 1; and further comprising a pair of metering tubes for each ball bearing, each tube having one end extending into said oil storage chamber, and an opposite end directed to a respective ball bearing to be lubricated with oil.

5. The pressure cylinder according to claim 1, wherein said ball bearings have an inner race mounted on said oil storage chamber.

6. The pressure cylinder according to claim 1, wherein said receiving shaft has an axis of rotation, and wherein said oil in said oil storage chamber reaches a level above said axis.

* * * * *

UNITED STATES PATENT AND TRADEMARK OFFICE

CERTIFICATE OF CORRECTION

PATENT NO. : 5,174,206

DATED : Dec. 29, 1992

INVENTOR(S) : Bruno Molinatto

It is certified that error appears in the above-identified patent and that said Letters Patent is hereby corrected as shown below:

On the title page, item:

"[73] Assignee: Componenti Grefici S.r.l., Italy"

To:

--[73] Assignee: Componenti Grafici S.r.l., Italy --.

Signed and Sealed this

Thirtieth Day of November, 1993

Bruce Lehman

*Attest:*

BRUCE LEHMAN

*Attesting Officer*

*Commissioner of Patents and Trademarks*